US009693643B1

(12) United States Patent
Laskowitz et al.

(10) Patent No.: US 9,693,643 B1
(45) Date of Patent: Jul. 4, 2017

(54) PRODUCT DISPLAY ASSEMBLY

(71) Applicant: Target Brands, Inc., Minneapolis, MN (US)

(72) Inventors: Adam M. Laskowitz, San Francisco, CA (US); Faith J. Hutchinson, Berkeley, CA (US); Patricia S. Adler, Oakland, CA (US); Brett S. Bowman, San Francisco, CA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/138,634

(22) Filed: Apr. 26, 2016

(51) Int. Cl.
*A47F 7/02* (2006.01)
*A47F 7/024* (2006.01)
*A47F 5/04* (2006.01)

(52) U.S. Cl.
CPC ..... *A47F 7/022* (2013.01); *A47F 5/04* (2013.01); *A47F 7/024* (2013.01)

(58) Field of Classification Search
CPC .. A47F 7/02; A47F 7/022; A47F 7/024; A47F 7/143; A47F 5/04; A47F 5/106; A45C 11/16
USPC ..... 211/85.2; 248/219.2
See application file for complete search history.

(56) References Cited

U.S. PATENT DOCUMENTS 855,138 A * 5/1907 Sciple ..... E04H 12/10 52/40
1,445,803 A * 2/1923 Small ..... A47F 7/12 211/144
1,738,869 A * 12/1929 Cizek ..... A47F 7/12 211/163
2,692,689 A 12/1951 Wynne, Sr.
2,650,983 A * 9/1953 Ehrbar ..... H01Q 5/378 248/219.2
2,951,589 A 9/1960 Dudley
3,567,034 A * 3/1971 Mozelsio ..... E05B 69/006 211/7
4,282,976 A 8/1981 Fitzgerald
4,390,099 A 6/1983 Trautlein et al.
4,799,588 A 1/1989 Trisl
4,887,727 A * 12/1989 Simmerman ..... A47G 25/0692 211/124
5,160,048 A * 11/1992 Leyden ..... A47F 7/24 211/7
6,241,105 B1 6/2001 Pomper
(Continued)

OTHER PUBLICATIONS

Image of Display Fixture 1, publicly available at least as early as Dec. 16, 2015, 1 page.

(Continued)

*Primary Examiner* — Ko H Chan
(74) *Attorney, Agent, or Firm* — Leanne Taveggia Farrell; Westman, Champlin & Koehler, P.A.

(57) ABSTRACT

A product display assembly includes a post extending substantially vertically from a top surface of a display table, an elongated rod and a security bar. The elongated rod has first and second free ends and is mounted to a top of the post so that a length of the elongated rod is oriented substantially perpendicular to the post. The elongated rod has a thickness that is greater than a thickness of the post. The security bar has a first end, a second end, an inner side and an outer side. The inner side of the security bar is mounted flush to a back of the elongated rod to secure product being displayed on the elongated rod.

12 Claims, 3 Drawing Sheets

(56) References Cited

U.S. PATENT DOCUMENTS

| | | | | |
|---|---|---|---|---|
| 7,182,416 | B1 * | 2/2007 | Greiner | A47F 7/02 206/6.1 |
| 7,444,917 | B1 * | 11/2008 | Elliott | D04C 7/00 87/62 |
| 8,474,716 | B2 * | 7/2013 | Louie | A61J 1/16 211/13.1 |
| 9,107,514 | B1 | 8/2015 | Morieras | |
| 2008/0088210 | A1 | 4/2008 | Lerman | |
| 2012/0217208 | A1 * | 8/2012 | Levi | A47F 5/106 211/4 |
| 2013/0087081 | A1 * | 4/2013 | Stukenberg | A47F 7/02 108/23 |

OTHER PUBLICATIONS

Image of Display Fixture 2, publicly available at least as early as Dec. 16, 2015, 1 page.
Image of Display Fixture 3, publicly available at least as early as Dec. 16, 2015, 1 page.

* cited by examiner

PRODUCT DISPLAY ASSEMBLY

BACKGROUND

Retail stores use a variety of display fixtures to present products to customers for purchase. These display fixtures can support the product, indicate the product price, include signage for highlighting the product and/or include structures that hold samples of the product for testing.

The discussion above is merely provided for general background information and is not intended to be used as an aid in determining the scope of the claimed subject matter.

SUMMARY

A product display assembly includes a post, an elongated rod and a security bar. The post extends substantially vertically from a top surface of a display table. The elongated rod has first and second free ends and is mounted to a top of the post so that a length of the elongated rod is oriented substantially perpendicular to the post. The elongated rod has a thickness that is greater than a thickness of the post. The security bar has a first end, a second end, an inner side and an outer side. The inner side of the security bar is mounted flush to a back of the elongated rod to secure product being displayed on the elongated rod.

A product display assembly includes a post mounted to a top surface of a display table and extending substantially vertically from the top surface of the display table to a distal end. A cylinder having a first free end, a second opposing free end, a side and a length is mounted to the distal end of the post so that the length of the cylinder is oriented substantially perpendicular to the substantially vertically oriented post. The cylinder has a diameter that is greater than a thickness of the post. A bar is mounted flush to the cylinder to secure product to the cylinder and includes a plurality of grooves that form channels for accommodating the product being displayed on the cylinder.

A method of displaying products on a product display assembly includes mounting a post to a display table so that it extends substantially vertically from a top surface of the display table. An elongated rod having first and second free ends is mounted to a top of the post so that the elongated rod is oriented substantially perpendicular to the post. The elongated rod has a diameter that is greater than a thickness of the post. Products are placed on the elongated rod so that each product encircles the elongated rod. Each of the products encircling the elongated rod are secured by attaching a security bar having a first end, a second end, an inner side and an outer side to a back of the elongated rod and over each product that encircles the elongated rod.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A product display assembly is described herein that supports sample products, such as expensive wristwatches, wristbands or activity trackers that are mounted to wristbands made by certain manufacturers under tradenames such as Jawbone® and Fitbit®. The product display assembly supports and displays sample products in an attractive manner that is easy and convenient for customers to view and interact with. Normally, when wristwatches or activity trackers are displayed on an arm, the back and ends of the arm are secured down or the arm is placed under glass. In these normal configurations, a portion of the watch is not visible to the customer or incapable of being interacted with. In the below described product display assembly, the ends of the arm that display the wristwatches or activity trackers are free and the entire watch is visible while still being secured to prevent shoplifting.

Figure 1:
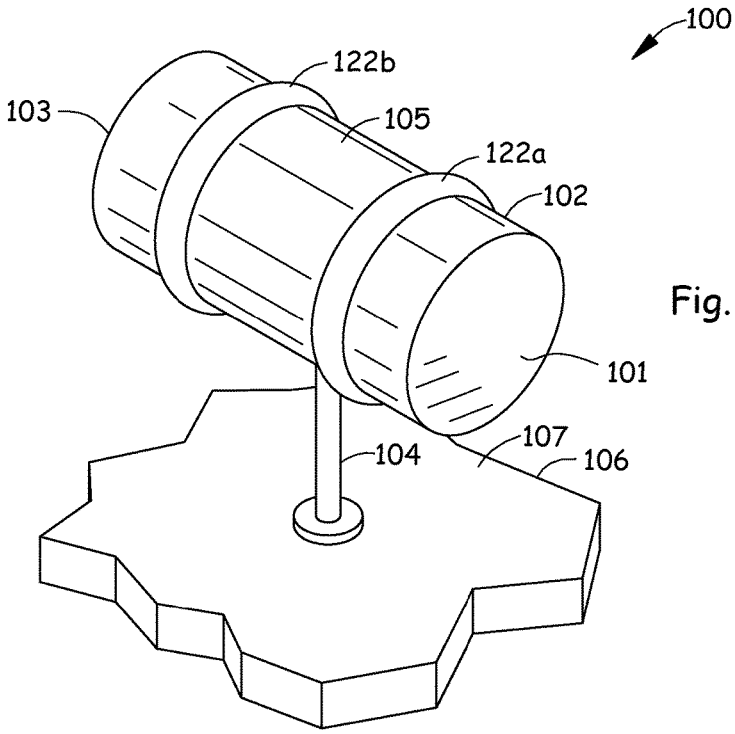
FIG. 1 is a front perspective view of a sample product display assembly according to one embodiment.
Figure 2:
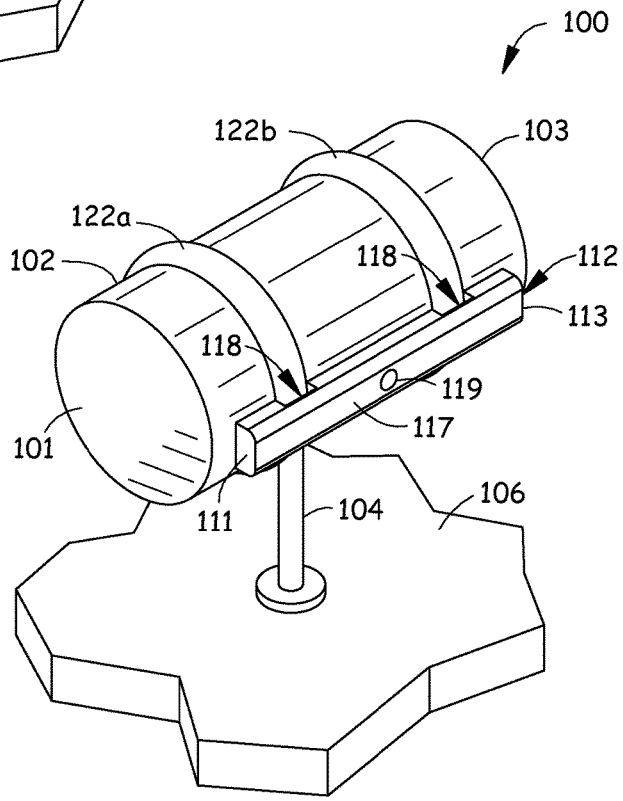
FIG. 2 is a back perspective view of FIG. 1.
Figure 3:
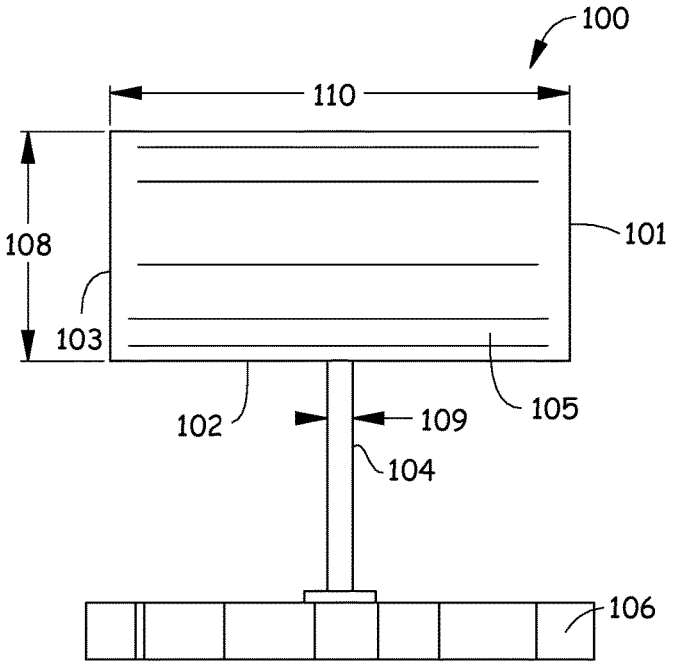
FIG. 3 is a front view of FIG. 1.
Figure 4:
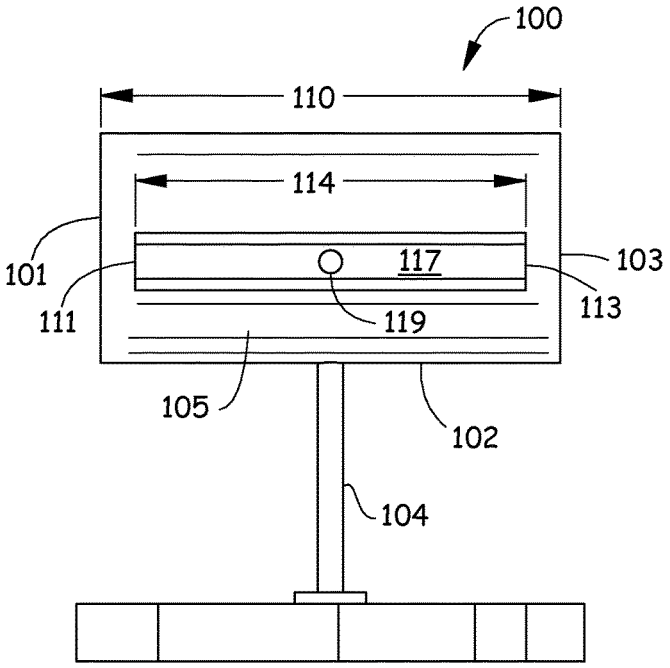
FIG. 4 is a back view of FIG. 1.
Figure 5:
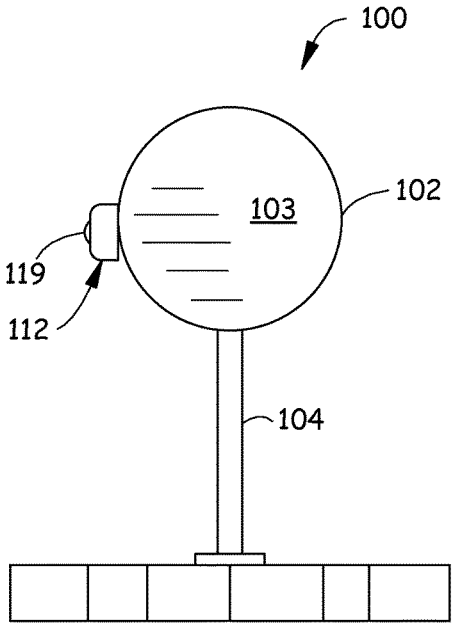
FIG. 5 is a left side view of FIG. 1.
Figure 6:
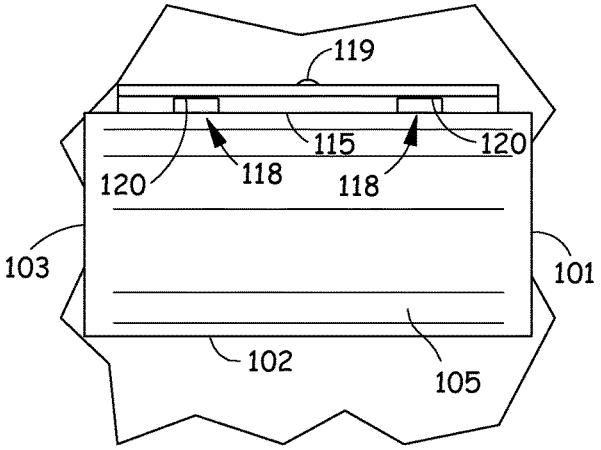
FIG. 6 is a top view of FIG. 1.

FIG. 1 is a front perspective view of a sample product display assembly 100. FIG. 2 is a back perspective view, FIG. 3 is a front view, FIG. 4 is a back view, FIG. 5 is a left side view, the right side being a mirror image and FIG. 6 is a top view. Product display assembly 100 includes an elongated rod or cylinder 102 mounted to a post 104 that is secured to a display table 106. As illustrated in FIG. 1-5, post 104 extends substantially vertically from a top surface 107 of display table 106 and elongated rod or cylinder 102 is oriented substantially horizontally so that elongated rod or cylinder 102 is substantially perpendicular to post 104.

Elongated rod or cylinder 102 includes a first free end 101, a second opposing free end 103 and a side 105. Elongated rod or cylinder 102 is made of various types of solid materials, such as acrylic and the like, and includes a thickness or diameter 108 and a length 110 (FIG. 3). For example, elongated rod or cylinder 102 can be made of a transparent acrylic that is sanded or blasted so that the exterior surface of elongated rod or cylinder 102 becomes opaque. As illustrated, length 110 is greater than thickness or diameter 108 (see FIG. 3). Length 110 can be of varying sizes, but should be long enough to hold and display at least two wristbands. Thickness or diameter 108 is directly related to the standard size of a person's wrist so that wristwatches or activity trackers that are worn around the wrist can be displayed on elongated rod or cylinder 102.

Elongated rod or cylinder 102 is mounted to a top end or distal end of post 104 so that length 110 of elongated rod or cylinder 102 is oriented substantially perpendicular to post 104. Thickness or diameter 108 is greater than a thickness or diameter 109 of post 104 (see FIG. 3). How elongated rod or cylinder 102 is mounted to post 104 will be discussed in detail below.

Product display assembly 100 further includes an elongated security bar 112. Elongated security bar 112 is illustrated in FIGS. 1-6 attached to elongated rod or cylinder 102 using fastener 119 and also illustrated alone in a perspective view in FIG. 7. Elongated security bar 112 includes a first end 111, a second end 113, an inner side 115 and an outer side 117. Elongated security bar 112 is fastened to a back of elongated rod or cylinder 102 as shown in FIGS. 2, 4, 5 and 6 to secure the wristwatches or activity trackers to elongated rod or cylinder 102 for display. In particular, inner side 115 is mounted flush to the back of elongated rod or cylinder 102 along its side 105. Elongated security bar 112 includes a length 114 that is less than or equal to length 110 of elongated rod or cylinder 102. As illustrated in the embodiment of FIG. 4, length 114 is less than length 110.

Elongated security bar 112 includes a plurality of grooves 118 that are recessed from inner side 115 to recessed surfaces 120. Recessed surfaces 120 are located between inner side 115 and outer side 117. Each of the plurality of grooves 118 form a channel when inner side 115 of security bar 112 is mounted flush to a back of side 105 of elongated rod or cylinder 102 as is illustrated in FIGS. 2, 5 and 6. Each channel formed by each groove 118 is for accommodating a product being displayed on elongated rod or cylinder 102.

The distance to which each groove 118 is recessed from inner side 115 to recessed surface 120 must be great enough to accommodate the thickness of a product or wristband, for example product or wristband 122*a* and 122*b*. In some instances, the distance to which recessed surface is recessed from inner side 115 is small enough that recessed surface 120 fits snug against or contacts product or wristband 122*a* and 122*b*. In other instances, the distance to which recessed surface is recessed from inner side 115 is great enough that recessed surface 120 is spaced apart from product or wristband 122*a* and 122*b*.

As illustrated in FIG. 2, each product or wristband 122*a* and 122*b* is located in one of the channels formed by each groove 118. Therefore, as is illustrated, a number of the plurality of grooves 118 that are recessed from inner side 115 of elongated rod or cylinder 102 corresponds with a maximum number of products that are to be displayed on the elongated rod or cylinder 102. As illustrated, security bar 112 includes two grooves 118 and therefore elongated rod or cylinder 102 can display as many as two products or wristbands.

Figure 8:
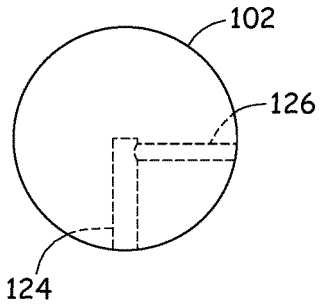
FIG. 8 is a diagrammatic end view of an elongated rod of the sample product display assembly illustrated in FIG. 1.

FIG. 8 is a diagrammatic end view of elongated rod or cylinder 102 of the sample product display assembly 100 illustrated in FIG. 1. Elongated rod or cylinder 102 includes a plurality of bores for mounting the elongated rod or cylinder 102 to post 104 and for mounting security bar 112 to elongated rod or cylinder 102. Each of the plurality of bores intersect with side 105 of elongated rod or cylinder 102. As illustrated in FIG. 8, elongated rod or cylinder 102 includes a first bore 124 and a second bore 126. However, it is possible, although not illustrated, for elongated rod or cylinder 102 to include a third bore.

First bore 124 extends substantially perpendicular to length 110 of elongated rod or cylinder 102, intersects with side 105 at a bottom of elongated rod or cylinder 102 and is configured to receive the top or distal end of post 104 for attaching the post to the elongated rod or cylinder. Second bore 126 extends substantially perpendicular to and intersects first bore 124, intersects with side 105 at a back of elongated rod or cylinder 102 and is configured to receive a fastener 119. Fastener 119 in combination with second bore 126 perform two functions.

Figure 7:
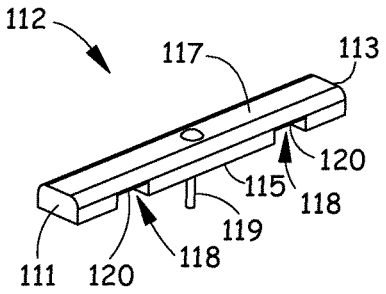
FIG. 7 is a perspective view of a security bar of the sample product display assembly illustrated in FIG. 1.

First, fastener 119 acts as a set screw for holding the top or distal end of post 104 in first bore 124. Second, fastener 119 fastens security bar 112 to elongated rod or cylinder 102. To perform this function, fastener 119 extends through a hole in the center of security bar 112 as illustrated in FIG. 7 and extends into second bore 126 to secure security bar 112 to elongated rod or cylinder 102. In other embodiments, elongated rod or cylinder can include two bores that are substantially perpendicular to length 110. One of these bores would intersect bore 124 and receive a set screw for holding the top or distal end post 104. The other of these bores would be spaced apart from the bore that receives the set screw and be configured to receive the fastener that fastens security bar 112 to elongated rod or cylinder 102.

In one embodiment and as previously described, elongated rod or cylinder 102 can be made of a transparent acrylic that is sanded or blasted so that the exterior surface of elongated rod or cylinder 102 becomes opaque. In this embodiment, the opaque surfaces hide the top or distal end of post 104 and fastener 119, which holds security bar 112 to elongated rod or cylinder 102 and for holding post 104 in place.

A method of displaying products on a product display assembly is also provided. As illustrated in FIGS. 1-6, post 104 is mounted to display table 106 so that it extends substantially vertically from top surface 107 of the display table. Elongated rod or cylinder 102 having first and second free ends 101 and 103 is mounted to a top of post 104 so that elongated rod or cylinder 102 is oriented substantially perpendicular to post 104. Elongated rod or cylinder 102 has a diameter 108 that is greater than thickness 109 of post 104. As illustrated in FIGS. 1 and 2, products 122*a* and 122*b* are placed on elongated rod or cylinder 102 so that each product 122*a* and 122*b* encircles elongated rod or cylinder 102. While FIGS. 1 and 2 illustrate two products being placed on elongated rod or cylinder 102, it should be realized any number of products can be placed on elongated rod or cylinder 102 as long as there is requisite space and security bar 112 includes the same or greater amount of grooves. Each of the products 122*a* and 122*b* encircling the elongated rod or cylinder 102 are secured by attaching security rod 112 having first end 111, second end 113, inner side 115 and outer side 117 to a back of elongated rod or cylinder 102 and over each product 122*a* and 122*b* that encircles the elongated rod or cylinder.

When mounting elongated rod or cylinder 102 to post 104, the method further includes inserting the top or distal end of post 104 in a first bore 124 in elongated rod or cylinder 102 and inserting fastener 119 into second bore 126 to act as a set screw. As previously described, second bore 126 is substantially perpendicular to and intersects first bore 124 so as to hold post 104 to elongated rod or cylinder 102. Fastener 119 is also inserted through a hole in a center of security rod 112 and received by second bore 126 in elongated rod or cylinder 102 to hold security bar 112 to elongated rod or cylinder 102.

When securing each of the products 122*a* and 122*b* that are encircling elongated rod or cylinder 102 by attaching security bar 112 to the back of the elongated rod or cylinder 102, the method further includes attaching security bar 112 so that the plurality of grooves 118 in security rod 112 that are recessed from inner side 115 to recessed surfaces 120 form a plurality of channels. The plurality of channels are defined by the back and side of elongated rod or cylinder 112 and grooves 118. Each channel holds a portion of each of the products 122*a* and 122*b* that are encircling elongated rod or cylinder 102.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A product display assembly comprising:

a post extending substantially vertically from a top surface of a display table;

an elongated rod having first and second free ends and being mounted to a top of the post so that a length of the elongated rod is oriented substantially perpendicular to the post, wherein the elongated rod has a thickness that is greater than a thickness of the post; and a security bar having a first end, a second end, an inner side and an outer side, wherein the inner side is mounted flush to a back of the elongated rod to secure product being displayed on the elongated rod;

wherein the elongated rod includes a first bore that extends substantially perpendicular to the length of the elongated rod and is configured to receive the top of the post for attaching the post to the elongated rod and a second bore that extends substantially perpendicular to and intersects the first bore and is configured to receive a fastener for holding the top of the post in the first bore, wherein the fastener is further configured to fasten the security bar to the elongated rod.

2. The product display assembly of claim 1, wherein the inner side of the security bar comprises a plurality of grooves that are recessed from the inner side to recessed surfaces that are located between the inner side and the outer side, wherein the plurality of grooves form a channels when the inner side of the security bar is mounted flush to the back of the elongated rod.

3. The product display assembly of claim 2, wherein a number of the plurality of grooves that are recessed from the inner side to a recessed surface corresponds with a maximum number of products that are to be displayed on the elongated rod.

4. The product display assembly of claim 1, wherein a length of the security bar is less than or equal to a length of the elongated rod.

5. The product display assembly of claim 1, wherein the fastener extends through a hole in the security bar and into the second bore to secure the security bar to the elongated rod.

6. A product display assembly comprising:

a post mounted to a top surface of a display table and extending substantially vertically from the top surface of the display table to a distal end;

a cylinder having a first free end, a second opposing free end, a side, a length and a first bore that receives the distal end of the post so that the cylinder is mounted to the post and the length of the cylinder is oriented substantially perpendicular to the substantially vertically oriented post, wherein the cylinder has a diameter that is greater than a thickness of the post;

a bar that is mounted flush to the cylinder to secure product to the cylinder and including a plurality of grooves that form channels for accommodating the product being displayed on the cylinder; and a fastener that extends through the bar and is received by a second bore in the cylinder that intersects with the first bore to fasten the bar to the cylinder and to hold the distal end of the post in the first bore.

7. The product display assembly of claim 6, wherein a number of the plurality of grooves in the bar corresponds with a maximum number of products that are to be displayed on the cylinder.

8. The product display assembly of claim 6, wherein the first bore extends substantially perpendicular to the length of the cylinder.

9. The product display assembly of claim 6, wherein the second bore extends substantially perpendicular to the length of the cylinder and is located on the back of the cylinder.

10. The product display assembly of claim 6, wherein the fastener extends through a hole in the bar.

11. A method of displaying products on a product display assembly comprising:

mounting a post to a display table so that it extends substantially vertically from a top surface of the display table;

mounting an elongated rod having first and second free ends to a top of the post so that the elongated rod is oriented substantially perpendicular to the post, wherein the elongated rod has a diameter that is greater than a thickness of the post;

placing products on the elongated rod so that each product encircles the elongated rod;

securing each of the products encircling the elongated rod by attaching a security bar having a first end, a second end, an inner side and an outer side to a back of the elongated rod and over each product that encircles the elongated rod;

wherein mounting the elongated rod to the post comprises inserting the top of the post in a first bore in the elongated rod and inserting a fastener into a second bore in the elongated rod that is substantially perpendicular to and intersects the first bore so as to hold the post to the elongated rod;

wherein attaching the security bar to the back of the elongated rod further comprises inserting the fastener that is inserted through the second bore in the elongated rod through a hole in the security bar.

12. The method of claim 11, wherein securing each of the products encircling the elongated rod by attaching the security bar to the back of the elongated rod comprises attaching the security bar so that a plurality of grooves in the security bar that are recessed from the inner side to recessed surfaces located between the inner side and the outer side form a plurality of channels when the inner side of the security bar is mounted flush to the back of the elongated rod, wherein each channel is configured to hold a portion of a respective one of the products encircling the elongated rod.

* * * * *